US007732389B2

(12) United States Patent
Sullivan et al.

(10) Patent No.: US 7,732,389 B2
(45) Date of Patent: Jun. 8, 2010

(54) LUBRICATING FLUIDS WITH LOW TRACTION CHARACTERISTICS

(75) Inventors: William T. Sullivan, Brick, NJ (US); Halou Oumar-Mahamat, Princeton, NJ (US); Martin N. Webster, Pennington, NJ (US); Ellen B. Brandes, Bound Brook, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1172 days.

(21) Appl. No.: 11/338,514

(22) Filed: Jan. 24, 2006

(65) Prior Publication Data

US 2006/0178279 A1 Aug. 10, 2006

Related U.S. Application Data

(60) Provisional application No. 60/650,206, filed on Feb. 4, 2005.

(51) Int. Cl.
*C10M 105/34* (2006.01)
*C10M 169/04* (2006.01)

(52) U.S. Cl. ..... 508/463; 508/505; 508/110

(58) Field of Classification Search ..... 508/505, 508/463, 110
See application file for complete search history.

(56) References Cited

U.S. PATENT DOCUMENTS

| | | | | |
|---|---|---|---|---|
| 4,827,064 | A | 5/1989 | Wu | 585/10 |
| 4,912,272 | A | 3/1990 | Wu | 585/10 |
| 4,956,122 | A | 9/1990 | Watts et al. | 252/565 |
| 4,990,711 | A | 2/1991 | Chen et al. | 585/302 |
| 5,242,469 | A * | 9/1993 | Sakakibara et al. | 44/347 |
| 5,360,562 | A | 11/1994 | Chrisope et al. | 252/46.6 |
| 5,858,934 | A | 1/1999 | Wiggins et al. | 508/486 |
| 5,863,873 | A | 1/1999 | Bovington | 508/501 |
| 5,962,381 | A | 10/1999 | Bovington | |
| 6,372,696 | B1 | 4/2002 | Tipton | |
| 6,713,438 | B1 | 3/2004 | Baillargeon et al. | 508/463 |
| 6,713,439 | B2 | 3/2004 | Watts | 508/485 |
| 2003/0207775 | A1 * | 11/2003 | Sullivan et al. | 508/463 |
| 2004/0029407 | A1 | 2/2004 | Liu et al. | |
| 2004/0038835 | A1 * | 2/2004 | Chasan et al. | 508/279 |
| 2004/0094453 | A1 | 5/2004 | Lok et al. | 208/19 |
| 2005/0241990 | A1 | 11/2005 | Ziemer et al. | 208/19 |

FOREIGN PATENT DOCUMENTS

| | | |
|---|---|---|
| DE | 3841609 | 6/1989 |
| EP | 0 088 453 | 5/1987 |
| EP | 0 295 304 | 6/1987 |
| EP | 0 339 088 | 2/1989 |
| EP | 1 416 033 | 5/2004 |
| GB | 2224287 | 5/1990 |
| JP | 59-191797 | 10/1984 |
| JP | 61-188495 | 8/1986 |
| JP | 01149897 | 6/1989 |
| WO | WO 03/091369 | 11/2003 |

OTHER PUBLICATIONS

Jackson et al., "The Effect of Lubricant Traction of Scuffing", Tribology Transactions, vol. 37, No. 2, pp. 387-395, (Apr. 1994).
Tuomas, R. et al., "*Influence of Molecular Structure on the Lubrication Properties of Four Different Esters*," Tribologia, 2000, vol. 19, No. 4, pp. 3-8.

* cited by examiner

*Primary Examiner*—Glenn Caldarola
*Assistant Examiner*—Jim Goloboy
(74) *Attorney, Agent, or Firm*—Nancy T. Krawczyk; Andrew B. Griffis

(57) ABSTRACT

The invention relates to lubricating fluids and oil formulations which provide exceptionally low traction, a method of lowering traction coefficients in lubricating compositions, and to uses of such compositions.

27 Claims, 9 Drawing Sheets

Relative Traction Coefficients - Mineral vs. PAO and PAGs

LUBRICATING FLUIDS WITH LOW TRACTION CHARACTERISTICS

CROSS REFERENCE TO RELATED APPLICATION

This application claims the benefit of Provisional Application No. 60/650,206 filed Feb. 4, 2005, the disclosure of which is incorporated by reference.

FIELD OF THE INVENTION

This invention relates to lubricating fluids and oils. Specifically, it is directed to compositions that provide for decreased traction coefficients, a method of lowering traction coefficients in lubricating compositions, and the uses of such compositions.

BACKGROUND OF THE INVENTION

Elastohydrodynamic lubrication (EHL) is the mode of lubrication that exists in non-conforming concentrated contacts. Examples include the contact between meshing gear teeth used in hypoid axles, worm gears, etc. and between the components in a rolling element bearing. In these contacts the load is supported over a very small contact area which results in very high contact pressures. As lubricants are drawn into the contact zone by the movement of the component surfaces, the lubricant experiences an increase in pressure. Pressures on the order of 1 GPa and above are common in EHL contacts. Most lubricating oils exhibit a large increase in viscosity in response to higher pressures. It is this characteristic that results in the separation of the two surfaces in the contact zone.

If there is relative sliding between the two contacting surfaces in the central contact region, the lubricant is sheared under these high-pressure conditions. The shearing losses depend on how the oil behaves under these extreme conditions. The properties of the oil under high pressure, in turn, depend on the type of base stocks used in the manufacture of the finished lubricant. The generation of the EHL film is governed by what happens in the inlet region of the contact; however, the energy losses are governed by what happens when the lubricant is sheared in the high-pressure central contact region.

The resistance of the lubricant to the shearing effects within an EHL contact is referred to as traction. This is not to be confused with friction, which is associated with surface interactions. The traction response is dominated by the shear behavior of the lubricant in the central high contact pressure region of an EHL contact. The traction properties generally depend on the base stock type.

Traction coefficients can be defined as the traction force divided by the normal force. The traction force is the force transmitted across a sheared EHL film. The normal force or contact load is the force of one element (such as a roller) pushing down on a second element. Therefore, the traction coefficient is a non-dimensional measure of the shear resistance imparted by a lubricant under EHL conditions. Lower traction coefficients result in lower shearing forces and hence less energy loss if the two surfaces are in relative motion. Low traction is believed to be related to improved fuel economy, increased energy efficiency, reduced operating temperatures, and improved durability.

FIG. 1 compares traction curves for a typical mineral oil and a typical PAO. As two surfaces move past one another, if they are moving at the same speed, there is pure rolling and no sliding. The lubricant is not sheared in the contact zone and no traction force is generated (% slide-roll ratio=0; traction coefficient=0; see FIG. 1). The % slide-to-roll ratio is defined as the difference in speed of the two surfaces divided by their average speed and multiplied by 100%. As the ratio of sliding to rolling increases (i.e., moving along the curves in FIG. 1 to the right) the lubricant begins to be sheared between the two surfaces, and since the oil is also under very high pressure, there is a rapid rise in the traction force which is transmitted across the lubricant film. In some cases, the lubricant behaves like an elastic solid. As the sliding increases still further, the traction coefficient may reach a maximum beyond which there is no further significant increase in traction. Under the conditions that exist in many gear and bearing contacts, this maximum is thought to be associated with reaching a maximum yield stress that can be supported by the lubricant. This maximum is determined by the conditions in the contact as well as the type of lubricant used.

As shown in FIG. 1, the PAO has a much lower traction coefficient, relative to mineral oil, over the range of slide-roll ratios, pressures and temperatures evaluated. This means that less energy will be required to shear the EHL film which separates moving surfaces. When gear oils are formulated based on PAO vs. mineral oil, one sees the same lowering of the traction coefficient. This concept is well documented in the industry.

It is also well documented that certain types of synthetic base stocks can provide reduced traction over a wide range of conditions. FIG. 2 is a qualitative comparison of traction coefficients of typical mineral oils, PAOs, and polyalkylene glycols (PAGs).

U.S. Pat. No. 4,956,122 discloses combinations of high and low viscosity synthetic hydrocarbons. A composition is claimed comprising a PAO having a viscosity of between 40 and 1000 cSt (100° C.), optionally further comprising a synthetic hydrocarbon having a viscosity of between 1 and 10 cSt (100° C.), a carboxylic acid ester having a viscosity of between 1 and 10 cSt (100° C.), an additive package, and mixtures thereof.

U.S. Pat. No. 5,360,562 teaches a transmission fluid comprising a PAO having a viscosity of from about 2 to about 10 cSt (100° C.) and a PAO having a viscosity in the range of about 40 to about 120 cSt (100° C.) and devoid of high molecular weight viscosity index improvers.

U.S. Pat. No. 5,863,873 teaches a composition comprising a base oil having a viscosity of about 2.5 to about 9 cSt (or $mm^2/s$) at 100° C. as a major component and a fuel economy improving additive comprising a polar compound with a viscosity greater than the bulk lubricant present from 2 to about 15 wt % of the composition. The compositions are said to improve fuel economy in an internal combustion engine.

U.S. Pat. No. 6,713,438 is directed to engine oils comprising a basestock having a viscosity of from 1.5 to 12 cSt (100° C.) blended with two dissolved polymer components of differing molecular weights.

U.S. Pat. No. 6,713,439 is directed to a composition comprising a PAO with a viscosity of about 40 cSt (100° C.), a basestock having a viscosity of from 2 to 10 cSt (100° C.), and a polyol ester.

Publication WO 03/091369 discloses lubricating compositions comprising a high viscosity fluid blended with a lower viscosity fluid, wherein the final blend has a viscosity index greater than or equal to 175. In an embodiment, the high viscosity fluid is preferably a polyalphaolefin and/or the lower viscosity fluid comprises a synthetic hydrocarbon. In another embodiment, the novel lubricating compositions of the present invention further comprise one or more of an ester, mineral oil and/or hydroprocessed mineral oil.

Publication US2003/0207775 is directed to compositions including a higher viscosity fluid (40 cSt to 3000 cSt at 100° C.) and a lower viscosity fluid (less than or equal to 40 cSt at 100° C.) wherein the final blend has a viscosity index of greater than or equal to 175. All of the examples include a PAO 2 ("SHF™ 23") as well as a higher viscosity PAO.

Publications US 2004/0094453 and 2005/0241990 are directed to the use of Fischer-Tropsch derived distillate fractions, the latter patent application said to be related to low traction coefficients.

Publication US2004/029407 discloses lubricating compositions comprising high viscosity PAOs blended with a lower viscosity ester, wherein the final blend has a viscosity index greater than or equal to 200, including a composition comprising a PAO having a viscosity of greater than or equal to about 40 cSt at 100° C. and less than or equal to about 1,000 cSt at 100° C.; and an ester having a viscosity of less than or equal to about 2.0 cSt at 100° C., wherein said blend has a viscosity index greater than or equal to about 200.

"Effect of Lubricant Traction on Scuffing", STLE Tribology Transactions, Vol. 37 No., Apr. 2, 1994, p. 387-395 reported the use of low traction PAO-based lubricants with mineral oils in basestock, antiwear and extreme pressure (EP) formulations and at both high (greater than 6) and moderate (approximately 1.2) specific film thickness lambda. At lambda greater than 6, the benefits of the synthetics over their mineral counterparts ranged from 25 percent to 220 percent and at lambda nearly 1.2, the benefits were a uniform 40 percent. It was particularly interesting to observe that the antiwear PAO-based oil gave a similar scuff load per unit contact width to an EP mineral gear oil. In addition, it was shown that scuffing load increased with decreasing traction coefficient.

"Influence of Molecular Structure on the Lubrication Properties of Four Different Esters", Tribologia, Vol. 19 No. 4, 2000, p. 3-8, compared the lubricating properties of esters. The lubrication properties that were expected to be dependent on chemical structure such as film thickness and traction, viscosity and friction coefficients were compared by experiment. The results showed that molecular length has a significant influence on lubrication properties, with longer molecules giving the highest viscosity and greatest film thickness. The length of the molecule did not influence the coefficients of friction, but the traction coefficient, gamma, decreased with increasing molecular length.

Other references of interest include U.S. Pat. Nos. 4,956,122; 4,912,272; 4,990,711; 5,858,934; and EP 088453.

The present inventors have discovered that certain fluids act as traction reducers when combined with higher viscosity fluids and that blends of traction reducers and higher viscosity fluids will increase the efficiency of gear systems.

SUMMARY OF THE INVENTION

The invention is directed to fluids, referred to herein as traction reducers, which have the ability to impart low traction characteristics to compositions incorporating them, and to a method of modifying the traction coefficient of high viscosity fluids by the addition of these traction reducer fluids thereto. The invention is also directed to the use of traction reducers in compositions, and also the use of said compositions with machine elements in which sliding and rolling is observed, i.e., non-conforming concentrated contacts, such as with roller and spherical bearings, hypoid gears, worm gears, and the like.

In some embodiments, the traction reducers may be blended with at least one other Group I-V basestocks, optionally with additives and/or viscosity index (VI) improvers. In other embodiments, the invention may be a blend of traction reducers and basestocks and may be further characterized by the absence of high molecular weight VI improvers, particularly those VI improvers having a molecular weight of 100,000 or greater.

In other embodiments, the traction reducers may be blended with at least one basestock selected from esters (especially monobasic acid esters), PAGs, and alkylated naphthalenes.

In preferred embodiments, the traction reducer is selected from Group IV basestocks, Group V basestocks, and mixtures thereof. In other preferred embodiments, the traction reducer is selected from esters, PAOs, hydrocarbon fluids, and mixtures thereof.

In an embodiment, the traction reducers are characterized as fluids having a viscosity of less than or equal to 3 cSt or less than or equal to 1.5 cSt, or less than or equal to 1.3 cSt, or less than or equal to 1.2 cSt, or less than or equal to 1.0 cSt at 100° C., and in a preferred embodiment are further characterized by having a carbon number of C5 to C30.

In another embodiment, a lubricating composition comprises one or more traction reducers according to the present invention blended with at least one fluid having a viscosity greater than the traction reducer(s), wherein the resulting blend has a traction coefficient lower than the traction coefficient of said second fluid(s).

In yet another embodiment, the traction reducer is blended with a higher viscosity fluid, preferably selected from PAOs.

It is an object of the invention to characterize traction reducers and provide a method of decreasing the traction coefficient of lubricant compositions.

It is another object of the invention to provide useful compositions exhibiting low traction coefficients.

Another object of the invention is to provide a method of increasing eh efficiency of gear systems and/or improve the fuel efficiency of machines including said gear systems.

It is still another object of the invention to provide low traction coefficient lubricants suitable for use in machine elements in which sliding and rolling is observed, i.e., non-conforming concentrated contacts, such as with roller and spherical bearings, hypoid gears, worm gears, and the like. Fluids that exhibit low traction properties will reduce the losses in components that contain sliding EHL contacts.

These and other embodiments, objects, features, and advantages will become apparent as reference is made to the following detailed description, including figures, tables, preferred embodiments, examples, and the appended claims.

DETAILED DESCRIPTION

Figure 1:
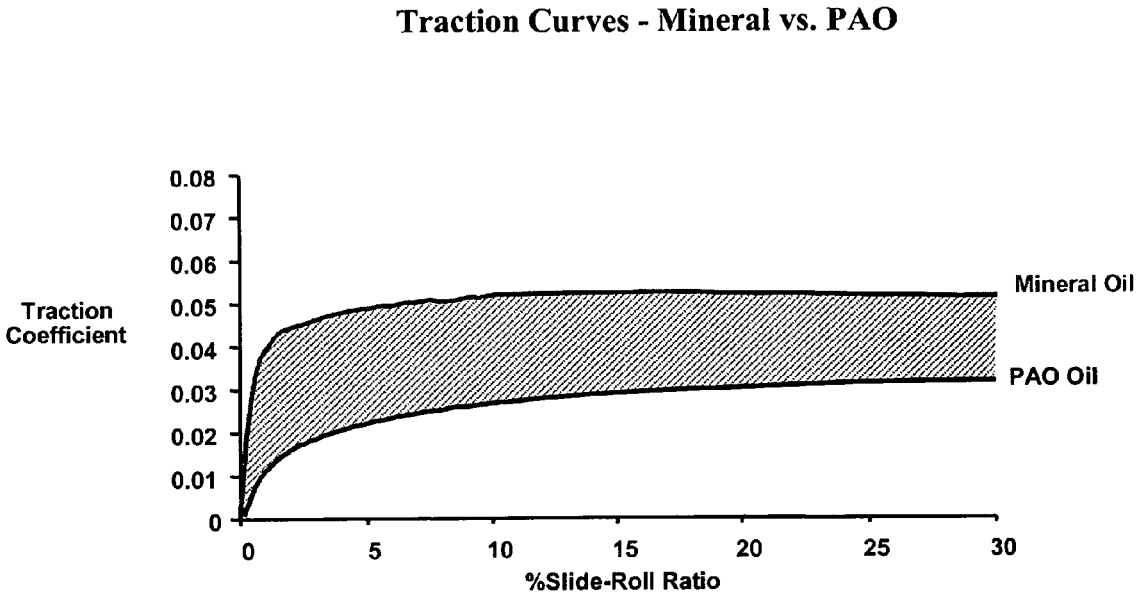
FIG. 1 shows an idealized traction curve comparing typical mineral oils with typical PAO oils.
Figure 2:
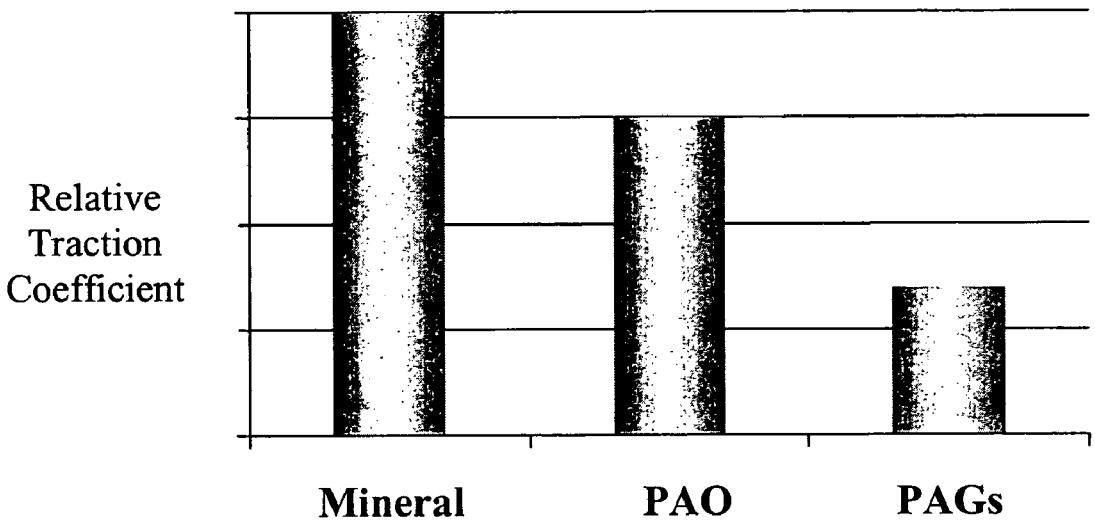
FIG. 2 compares relative values of traction coefficients for mineral oils, PAOs, and PAGs.

The invention is directed to low traction coefficient lubricants and lubricant compositions in the preparation of finished gear, transmission, engine, and industrial lubricants and in a preferred embodiment are used as lubricants for non-conforming concentrated contacts with high sliding such as spur gears, helical gears, hypoid gears, bevel gears, worm gears and the like.

In an embodiment, the low traction coefficient lubricants comprise "traction reducers," which may be used to modify base fluids having higher traction, to produce compositions having lower traction coefficients than the base fluids. In an embodiment, the traction reducers are extremely low viscosity (or low molecular weight) fluids. In an embodiment, these traction reducers are blended with high viscosity fluids, with the resulting blends exhibiting low traction properties. In yet another embodiment they are used to formulate viscosity grade lubricants, e.g. those that meet the requirements of SAE J306, the viscosity classification for automotive gear oils, or the requirements of ISO 3448, the industrial oil classification system. The traction reducer is a low viscosity fluid, which in an embodiment will be a viscosity of ≦3 cSt, or <3 cSt, or ≦2 cSt, or <2 cSt, or ≦1.5 cSt or <1.5 cSt, or ≦1.3 cSt, or ≦1.2 cSt or ≦1 cSt, or <1 cSt. and possessing a traction coefficient less than the base oil that it is to be combined with. Viscosities used herein are kinematic viscosities unless otherwise specified, determined at 100° C. according to any such suitable method for measuring kinematic viscosities, e.g. ASTM D445.

For purposes of the present invention, the term "traction reducers" excludes therefrom the Fischer-Tropsch derived fluids.

While it is believed that there is no lower limit to the viscosity of a traction reducer according to the invention they will typically have a viscosity of ≧0.5 cSt. Viscosities of at least some of the hydrocarbon fluids set forth herein, however, will have lower viscosities. It is critical, however, that the traction reducer be miscible with the basestock(s) with which it is combined. Otherwise the reduction in the traction coefficient of the resulting lubricating composition is severely reduced. The term miscible takes its ordinary meaning of "the ability to mix in all proportions". The inventors further define the meaning of this term as used herein to specify that miscibility is determined at 25° C. and 1 atm.

In preferred embodiments, the traction reducers according to the present invention will be further characterized by having a viscosity of from ≧0.5 cSt, or >0.5 cSt, or ≧1.0 cSt, or >1.0 cSt, or ≧1.5 cSt to ≦3 cSt, or <3 cSt, or ≦2 cSt, or <2 cSt.

Other preferred embodiments for the viscosity of traction reducers according to the invention include ≧0.5 cSt to ≦1.5 cSt, or ≧0.5 cSt to <1.5 cSt. Specific preferred embodiments include about 1.0 cSt fluids, 1.1 cSt fluids, 1.2 cSt fluids, 1.3 cSt fluids, 1.4 cSt fluids, 1.5 cSt fluids, about 2 cSt fluids, about 2.5 cSt fluids , or about 3 cSt fluids, and mixtures thereof. Again, the traction reducer may be a blend, so that, by way of example, it may be a blend of a 1.0 cSt fluid and a 2.0 cSt fluid, and so on.

While not critical to characterization of traction reducers according to the invention, typical carbon numbers of these materials would be from C5 to C30, in a preferred embodiment from C10 to C25, and in another preferred embodiment from C12 to C20. Additional embodiments are given herein, and it is to be understood that the various characteristics describing such embodiments may be combined to describe still further embodiments, as would be understood by one of ordinary skill in the art in possession of the present disclosure. Note that all carbon number ranges used herein refer to average carbon numbers, unless otherwise specified.

It has been surprisingly found that an efficient traction-reducing composition consists essentially of (a) at least one basestock characterized by having a viscosity greater than 3 cSt at 100° C. and (b) at least one traction reducer characterized by being miscible with said at least one basestock (a) and having a viscosity of less than or equal to 3 cSt (or in embodiments further characterized by one or more of the viscosity limitations set forth above) at 100° C. and having a traction coefficient less than the traction coefficient of said at least one basestock (a), wherein (a) is present in the amount of from 1 to 99 wt. %, and (b) is present in the amount of 99 wt. % to 1 wt. %, based on the weight of said lubricating composition; and wherein said lubricating composition is characterized by a traction coefficient less than the traction coefficient of (a) for every percent slide-to-roll ratio greater than 5%, measured over the operating range of 0.1 to 3.5 GPa peak contact pressure, −40° C. to 200° C. lubricant temperature, with a lubricant entraining velocity of from 0.25 to 10.0 m/s.

In other words, for the purpose of traction reduction, only a single traction reducing material is necessary; there is no necessity of having a second material with a low viscosity such as exemplified in U.S. patent application Ser. No. 2003/0207775, discussed above. Particularly in the case where the traction reducing material is a monobasic acid: ester, a low viscosity PAO is not required to obtain the traction coefficient reduction according to the present invention.

Fluids that can meet these criteria of traction reducers according to the present invention are varied. They may fall into any of the well-known American Petroleum Institute (API) categories of Group I through Group V. The API defines Group I stocks as solvent-refined mineral oils. Group I stocks contain the most saturates and sulfur and have the lowest viscosity indices. Group I defines the bottom tier of lubricant performance. Group II and III stocks are high viscosity index and very high viscosity index base stocks, respectively. The Group III oils contain fewer unsaturates and sulfur than the Group II oils. With regard to certain characteristics, both Group II and Group III oils perform better than Group I oils, particularly in the area of thermal and oxidative stability.

Group IV stocks consist of polyalphaolefins, which are produced via the catalytic oligomerization of linear alphaolefins (LAOs), particularly LAOs selected from C5-C14 alpha-olefins, preferably from 1-hexene to 1-tetradecene, more preferably from 1-octene to 1-dodecene, and mixtures thereof, although oligomers of lower olefins such as ethylene and propylene, oligomers of ethylene/butene-1 and isobutylene/butene-1, and oligomers of ethylene with other higher olefins, as described in. U.S. Pat. No. 4,956,122 and the patents referred to therein, and the like may also be used. PAOs offer superior volatility, thermal stability, and pour point characteristics to those base oils in Group I, II, and III.

Group V includes all the other base stocks not included in Groups I through IV. Group V base stocks includes the important group of lubricants based on or derived from esters. It also includes alkylated aromatics, polyinternal olefins (PIOs), polyalkylene glycols (PAGs), etc.

One of the great benefits of the present invention is that it is applicable to base oils fitting into any of the above five categories, API Groups I to V, as well as other materials, such as described below. As used herein, whenever the terminology "Group . . . " (followed by one or more of Roman Numerals I through V) is used, it refers to the API classification scheme set forth above.

Additional materials which may be used as traction reducers, either alone or combined with other types of traction reducers, may be classified simply as hydrocarbon fluids, such as ExxonMobil's Norpar™ fluids (comprising normal paraffins), and Isopar™ fluids (comprising isoparaffins), Exxsol™ fluids (comprising dearomatized hydrocarbon fluids), Varsol™ fluids (comprising aliphatic hydrocarbon fluids), which do not traditionally fall into any of the API categories and would not previously have been expected to be useful in such formulations. As used herein, the term "fluid" means materials that may function as one or more of a carrier, a diluent, a surface tension modifier, dispersant, and the like, as well as a material functioning as a solvent, in the traditional sense of a liquid which solvates a substance (e.g., a solute), and the term "hydrocarbon fluid" additionally means a material consisting of hydrogen and carbon atoms which is liquid at ambient temperature and pressure (25° C., 1 atm). Furthermore, the term "hydrocarbon fluid" as used herein is intended to exclude materials classified as API Group I-V materials, and also the Fischer-Tropsch derived fluids, and preferably will have an average carbon number from about C5 to C25. It will be recognized that commercially-available hydrocarbon fluids also typically contain small amounts of heteroatom-containing species (e.g., oxygen, sulfur, nitrogen, and the like), typically on the order of less than 1 wt. %, preferably less than 100 ppm. Heteroatom-containing materials may be substantially removed, if desired, by methods per se known in the art. In embodiments, the hydrocarbon fluids of the invention may be further characterized as selected from: (i) normal paraffins, preferably characterized by a viscosity at 25° C. (ASTM D445) of from about 1.6 to about 3.3 cSt and/or by a distillation range of from about 180 to about 280° C.; (ii) isoparaffins, preferably characterized by a viscosity at 25° C. (ASTM D445) of from about 0.7 to about 14.8 cSt, preferably from about 0.7 to about 4.0 cSt, and/or a distillation range of from about 200 to about 600° C., preferably from about 200 to about 500° C.; (iii) dearomatized aliphatics, preferably characterized by a viscosity at 25° C. (ASTM D445) of less than 7.0 cSt and/or a distillation range of about 135 to about 600 C; (iv) aliphatic hydrocarbons (in some cases referred to as naphtha), preferably characterized by a viscosity at 25° C. (ASTM D445) of less than 4.0 cSt, preferably less than 2.0 cSt and/or a distillation range of from about 60 to about 300° C.; and (v) mixtures thereof. As used herein, the term "distillation range" means that the material identified has an initial boiling point greater than or equal to the lower temperature (e.g., 60° C. for the aliphatic hydrocarbon example just given) specified and a dry point less than or equal to the higher temperature specified (e.g., 300° C. for the aliphatic hydrocarbon example just given). In another preferred embodiment, the hydrocarbon fluid blended in as traction reducer has a narrow boiling range of, for example, 50° C. or 40° C. or 30° C. or 20° C. The term "boiling range" is the temperature difference between when the material begins to boil and the dry point. Thus, by way of further example, in embodiments it is preferred to use a narrow boiling range cut of about 20° C. of naphtha within the preferred distillation range of about 60 to about 300° C.

Mixtures of one or more traction reducers combined with one or more higher viscosity base oil may be used. As an example, a hydrocarbon solvent such as Norpar® 12 fluid may be blended with PAO 2 and PAO 150 or it may be blended alone with the PAO 150, or it may be blended with PAO 100 and/or PAO 1000. All of these final compositions would meet the requirements. Note that the term "PAO x" (e.g., PAO 2) means that the material is a PAO having a kinematic viscosity of about x cSt at 100° C. PAO 2 and PAO 150 are commercially available, for instance, as SpectraSyn™ 2 and SuperSyn™ 2150, respectively, from ExxonMobil Chemical Company.

The treat rate of traction modifiers in finished lubricants may not be solely governed by the resulting traction performance. Other properties such as flash point, viscosity, seal compatibility, demulsibility, foam and air release, paint and sealant compatibility and volatility among others will also have to be considered. This is within the skill of the ordinary artisan, in possession of the present disclosure.

The traction reducers according to the invention are used (optionally with additives) to modify the traction of a high viscosity fluid, e.g. 100 cSt PAO, by creating a blend where the traction reducer (or mixture of traction reducers) is present in the amount of from 1 to 99 wt %, preferably from 5 to 95 wt %. In an embodiment, the traction reducer(s) is present in the blend in the amount of from 20 to 80 wt %, or from 30 to 70 wt %, or from 40 to 60 wt %, or from 45 to 55 wt %, based on the weight of the entire composition. Ranges from any lower limit to any upper limit are also contemplated, so that, by way of additional examples, traction reducer may be present in the blend in the amount of from 5 to 55 wt %, or from 45 to 95 wt %, and so on. Additional embodiments include traction reducers according to the present invention present in the amount of 5 to less than 50 wt %, greater than 50 to 95 wt %, greater than 70 to 95 wt %. All weight percentages used herein are based on the weight of the final composition, unless otherwise specified.

In more preferred embodiments, traction reducers may include very light neutral Group I and II mineral oils, which may be characterized by one of the aforementioned viscosities, and which may optionally be further characterized by the aforementioned carbon number ranges, e.g., C5-C30, and other embodiments set forth above. Group III hydrocracked stocks may also be suitable if they fall into the proper viscosity range, as previously described, and which may also be further characterized by the aforementioned carbon number ranges.

Group IV and V fluids having the aforementioned viscosity ranges and optional carbon number ranges are preferred embodiments of this invention.

Group IV basestocks are the polyalphaolefins. PAOs meeting the aforementioned viscosity criteria and preferably the aforementioned carbon numbers, for a traction reducer are particularly useful as traction reducers of the invention.

In an embodiment, more preferred PAOs are those low molecular weight hydrogenated oligomers of alpha olefins having carbon numbers from C10 to C30, preferably C12 to C25. In other embodiments, the carbon number range will be C12-C25, or C12 to C20. PAO 2 is a commercially-available PAO (as mentioned previously) that can serve as the low viscosity fluid useful as a traction reducer according to the present invention. Its average carbon number is approximately C20. Following the usual convention in the art, viscosities listed herein will be for 100° C. unless otherwise specified.

More generally, PAO fluids suitable for the present invention, as either lower viscosity (the traction reducer of the present invention), or higher viscosity fluids (the greater than 3 cSt at 100° C. according to ASTM D-445 material) depending on their viscosity properties, may be conveniently made by the polymerization of an alphaolefin in the presence of a polymerization catalyst, such as, by way of non-limiting example, Friedel-Crafts catalysts, including, for example, aluminum trichloride, boron trifluoride, or complexes of boron trifluoride with water, alcohols such as ethanol, propanol, or butanol, carboxylic acids, or esters such as ethyl acetate or ethyl propionate. Numerous methods are disclosed; see for instance, the patents listed in the aforementioned U.S. patent application Ser. No. 2003/0207775.

Group V basestocks meeting the aforementioned viscosity criteria and preferably the aforementioned carbon numbers for a traction reducer are likewise useful. Group V includes esters that are a preferred embodiment of a traction reducer. In a preferred embodiment, traction reducers according to the present invention may be selected from esters of mono and poly acids with monoalcohols or polyalcohols. Monobasic esters are preferred—they are the most readily available esters having viscosity sufficient to meet the criteria of a traction reducer according to the invention.

Esters that meet the criteria of the invention may be selected from the reaction product of at least one C1 to C20 alcohols and at least one C1 to C20 carboxylic acids to prepare a variety of esters that would meet the criteria of this invention, i.e. a kinematic viscosity of less than or equal to 3 cSt, or in embodiments characterized further by one or more of the viscosities set forth herein. The alcohols can be linear, cyclic, or branched. Near linear or less branched alcohols, such as described by Godwin in U.S. Pat. Nos. 6,969,735; 6,969,736; and 6,982,295; are used as the esterifying alcohol (s) in preferred embodiments. The esters can contain additional oxygen in the form of ethers and other heteroatoms, like N, and S. They can be saturated or unsaturated. There can be more than one hydroxy group per molecule, so diols and triols are also considered, however monobasic acid esters are preferred and in still more preferred embodiments polyol esters are excluded from compositions according to the invention. The same would hold true for the carboxylic acids: linear, branched, cyclic, saturated, unstaturated, with or without other heteroatoms, mono or poly carboxylic acids, although monocarboxylic acids are preferred. Some specific examples include the C8-C10 ester of pentanoic acid, C8-C10 ester of hexanoic acid, the C8-C10 ester of heptanoic acid, the C8-C10 ester of the C8-C10 acid, 2-ethylhexyl ester of C8-C10 acid, the isoctyl ester of C8-C10 acid, the isononyl ester of C8-C10 acid, pentaeyrithritol ester of C8-C10 acid, trimethylol propane ester of C8-C10, 2-ethylhexyl palmitate, isooctyl pentanoate, isononyl pentanoate, isononyl heptanoate, isooctyl isopentanoate, isononyl isopentanoate, 2-ethylhexyl 2-ethylhexanoate, isooctyl 2-ethylhexanoate, isononyl 2-ethylhexanoate, isononyl heptanoate, isooctyl heptanoate, isononyl isopentanoate, decyl heptanoate, nonyl heptanoate, ethyl decanoate, di-isooctyl adipate, neopentylglycol ester of pentanoic acid, the neopentylglycol ester of isopentanoic acid, neopentylgylcol ester of heptanoic and nonanoic acid, etc. Some preferred embodiments include isononyl heptanoate, the C8-C10 ester of pentanoic acid, the C8-C10 ester of heptanoic acid, iso-octyl pentanoate, isononyl pentanoate, isooctyl heptanoate, isooctyl isopentoate, and isononyl pentanoate.

Group V basestocks also include poly internal olefins (PIOs). Important PIOs useful in the present invention are PIOs having a viscosity less than or equal to 4 cSt (100° C.), preferably less than 3 cSt (100° C.), or in embodiments any of the viscosities listed above, more preferably those further characterized by the carbon ranges set forth herein. See, for instance, U.S. Pat. Nos. 6,686,511 and 6,515,193, with regard to PIOs per se.

Group V basestock components can also include hydrocarbon-substituted aromatic compounds, such as long chain alkyl substituted aromatics, including alkylated naphthalenes, alkylated benzenes, alkylated diphenyl compounds and alkylated diphenyl methanes. Here also, the viscosity of these fluids would be less than or equal to 3 cSt at 100° C., or in embodiments further characterized by any of the viscosities set forth above, While not critical to the characterization thereof, the carbon numbers of these are most preferably between C12 and C20.

The basestocks characterized by having a viscosity greater than 3 cSt at 100° C. are quite varied. The may be selected from any one of the API Group I-V materials, or mixtures thereof, provided they meet the viscosity limitations. PAOs are particularly preferred, and in preferred embodiments may be selected from HVI-PAOs and/or metallocene PAOs, Numerous PAOs are commercially available, such as PAO 150, PAO 100. Bright Stock (blend of API Group I with monobasic acid ester), and also Fischer-Tropsch derived materials and GTL or "gas to liquid" materials are all preferred embodiments of the high viscosity component (a).

Hydroisomerate/isodewaxate base stocks and base oils include base stocks and base oils derived from one or more Gas-to-Liquids (GTL) materials, slack waxes, natural waxes and the waxy stocks such as gas oils, waxy fuels hydrocracker bottoms, waxy raffinate, hydrocrackate, thermal crackates, or other mineral or non-mineral oil derived waxy materials, and mixtures of such base stocks.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stocks and base oils include oils boiling in the lube oil boiling range separated from GTL materials such as for example by distillation, thermal diffusion, etc., and subsequently subjected to well known solvent or catalystic dewaxing processes to produce lube oils of low pour point; wax isomerates, comprising, for example, hydroisomerized or isodewaxed synthesized waxy hydrocarbons; hydroisomerized or isodewaxed Fischer-Tropsch (F-T) material (i.e., hydrocarbons, waxy hydrocarbons, waxes and possible analogous oxygenates); preferably hydroisomerized or isodewaxed F-T waxy hydrocarbons or hydroisomerized or isodewaxed F-T waxes, hydroisomerized or isodewaxed synthesized waxes, or mixtures thereof. The GTL base stocks and base oil may be used as such or in combination with other hydroisomerized or isodewaxed materials comprising for example, hydroisomerized or isodewaxed mineral/petroleum-derived hydrocarbons, hydroisomerized or isodewaxed waxy hydrocarbons, or mixtures thereof, derived from different feed materials including, for example, waxy distillates such as gas oils, waxy hydrocracked hydrocarbons, lubricating oils, high pour point polyalphaolefins, foots oil, normal alpha olefin waxes, slack waxes, deoiled waxes, and microcrystalline waxes.

The GTL base stocks and base oils are typically highly paraffinic (>90 wt % saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock and base oil obtained by the hydroisomerization/isodewaxing of F-T material, especially F-T wax is essentially nil. Useful compositions of GTL base stocks and base oils, hydroisomerized or isodewaxed F-T material derived base stocks and base oils, and wax-derived hydroisomerized/isodewaxed base stocks and base oils, such as wax isomerates/isodewaxates, are recited in U.S. Pat. Nos. 6,080,301; 6,090,989, and 6,165,949 for example.

Wax isomerate/isodewaxate base stocks and base oils derived from waxy feeds which are also suitable for use in this invention, are paraffinic fluids of lubricating viscosity derived from hydroisomerized or isodewaxed waxy feedstocks of mineral or natural source origin, e.g., feedstocks such as one or more of gas oils, slack wax, waxy fuels hydrocracker bottoms, hydrocarbon raffinates, natural waxes, hyrocrackates, thermal crackates or other suitable mineral or non-mineral oil derived waxy materials, linear or branched hydrocarbyl compounds with carbon number of about 20 or greater, preferably about 30 or greater, and mixtures of such isomerate/isodewaxate base stocks and base oils.

While PAOs useful in the present invention for both the high and low viscosity components have already been mentioned, HVI-PAOs are a particularly preferred embodiment of the greater than 3 cSt (100° C., ASTM D-445) component. HVI-PAOs ("High Viscosity Index Polyalphaolefin") are per se well-known, and may be prepared by, for instance, polymerization of alpha-olefins using reduced metal oxide catalysts (e.g., chromium) such as described in U.S. Pat. Nos. 4,827,064; 4,827,073; 4,990,771; 5,012,020; and 5,264,642. These HVI-PAOs are characterized by having a high viscosity index (VI) and one or more of the following characteristics: a branch ratio of less than 0.19, a weight average molecular weight of between 300 and 45,000, a number average molecular weight of between 300 and 18,000, a molecular weight distribution of between 1 and 5, and pour point below −15° C. Measured in carbon number, these molecules range from C30 to C1300. Viscosities of the HVI-PAO oligomers useful in the present invention, measured at 100° C., range from greater than 3 cSt to about 15,000 cSt. These HVI-PAOs are commercially available, such as for instance SpectraSyn Ultra™ fluid, from ExxonMobil Chemical Co.

Another advantageous property of these HVI-PAOs is that, while lower molecular weight unsaturated oligomers are typically and preferably hydrogenated to produce thermally and oxidatively stable materials, higher molecular weight unsaturated HVI-PAO oligomers useful as lubricant are sufficiently thermally and oxidatively stable to be utilized without hydrogenation and, optionally, may be so employed. In embodiments, the. HVI-PAOs useful in the present invention may be prepared by non-isomerization polymerization of alpha-olefins using reduced metal oxide catalysts (e.g., reduced chromium on silica gel), zeolite catalysts, activated metallocene catalysts, or Zeigler-Natta ("ZN") catalyst.

For the purposes of the present invention, other preferred PAOs useful in blends with traction reducers may be characterized as including oligomers and/or polymers of C5-C14 linear alpha olefins (LAOs), particularly C8-C12 LAOs. Other suitable high viscosity fluids include other synthetic hydrocarbons, e.g. liquid ethylene propylene copolymers, polyisobutylenes, other polyolefins (e.g. PIOs), polymethacrylates. Other high viscosity fluids include mineral oils. Still other preferred high viscosity fluids would be those components of suitable viscosity in the API Group V category, e.g. high viscosity esters, alkylated napthalene, PAGs, etc.

In an embodiment, the invention includes the mixing of one or more low viscosity blend components selected from traction reducers set forth above, with one or more high viscosity fluids to provide lube weight fluids with low traction. These fluids may be combined with additive packages, thickeners, defoamants, VI improvers, pour point depressants, extreme pressure agents, anti-wear additives, demulsifiers, haze inhibitors, chromophores, anti-oxidants, dispersants, detergents, anti-rust additives, metal passivators, and the like, to provide lubricating oils for various automotive and industrial applications. The order of blending is not particularly critical and it will be recognized that adding a traction reducer to a basestock is substantially similar to adding the basestock to the traction reducer.

In embodiments, compositions according to the invention do not contains VI improvers. In more preferred embodiments, VI improvers having a molecular weight of about 100,000 and greater are excluded. Such ingredients are per se well-known in the art, such as disclosed in the above-mentioned U.S. Pat. Nos. 4,956,122 or 6,713,438. It is not particularly important whether the molecular weight of the VI improver is number average or weight average molecular weight. The molecular weight may be measured and determined by any known technique.

Compositions according to the present invention are particularly useful in applications wherein there are EHL contacts that have a component of sliding. Examples include spherical roller bearings, deep groove ball bearings, angular contact bearings among others. Additionally, most gear systems contain multiple sliding EHL contacts between meshing gear teeth. Examples include spur gears, helical gears, hypoid gears, bevel bears, worm gears, and the like.

An embodiment of the invention comprises a blend of at least one traction reducer with at least one higher viscosity material. In a preferred embodiment, at least one traction reducer is blended with a higher viscosity fluid to yield a gear lubricant that is SAE 70W or higher, based on the SAE J306 classification system. This classification system was designed to provide limits with respect to the kinematic viscosity at 100° C. and the Brookfield viscosity for automotive gear oils. Due to the nature of the traction reducers according to the present invention, when they are employed at concentrations where the traction coefficient of the final composition is significantly reduced relative to the traction coefficient of the higher viscosity fluid, cold temperature fluidity of the final composition is also affected because of the very low viscosity of the traction reducers. Consequently, the resulting gear lubricants that are formulated to contain the traction reducers described by this invention will, in embodiments, have significantly lower Brookfield viscosities than gear lubricants with similar kinematic viscosities that do not contain the traction reducers. Brookfield viscosities used herein are measure according to ASTM D-2983.

In a preferred embodiment, a lubricating oil composition is provided which comprises at least one traction reducer according to the invention, characterized by a low viscosity of ≦3 cSt at 100° C., and at least one fluid characterized by having a viscosity greater than the traction reducer, wherein the resulting composition has a traction coefficient that is lower than the traction coefficient of the higher viscosity fluid.

Figure 3:
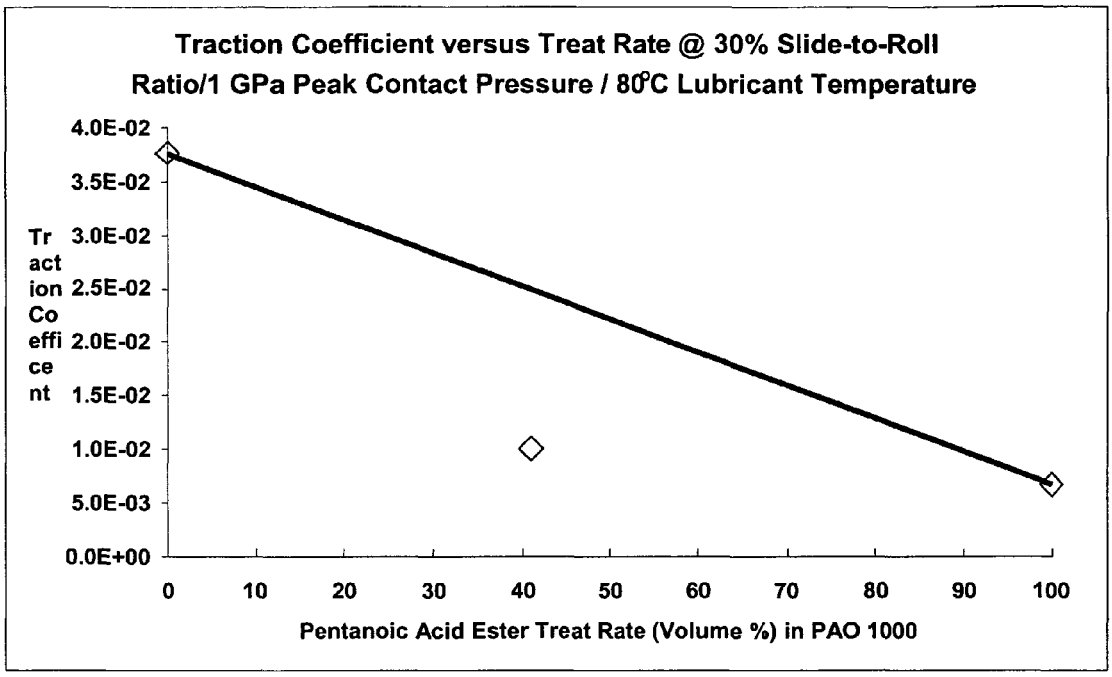
FIGS. 3-9 illustrate experimental results for various embodiments of the invention and comparative compositions.

An important feature of the traction modifiers is their ability to reduce traction below that of a linear reduction based on their treat rate in the final blend. As an illustration FIG. 3 shows the traction coefficient results obtained for 3 different compositions (100/0, 41/59, and 0/100 wt. % of pentanoic acid ester/PAO 1000 respectively). The traction coefficient at 41% pentanoic acid falls significantly below the line predicted by a simple linear variation of traction with blend composition. This feature is a preferred embodiment of the invention.

Figure 4:
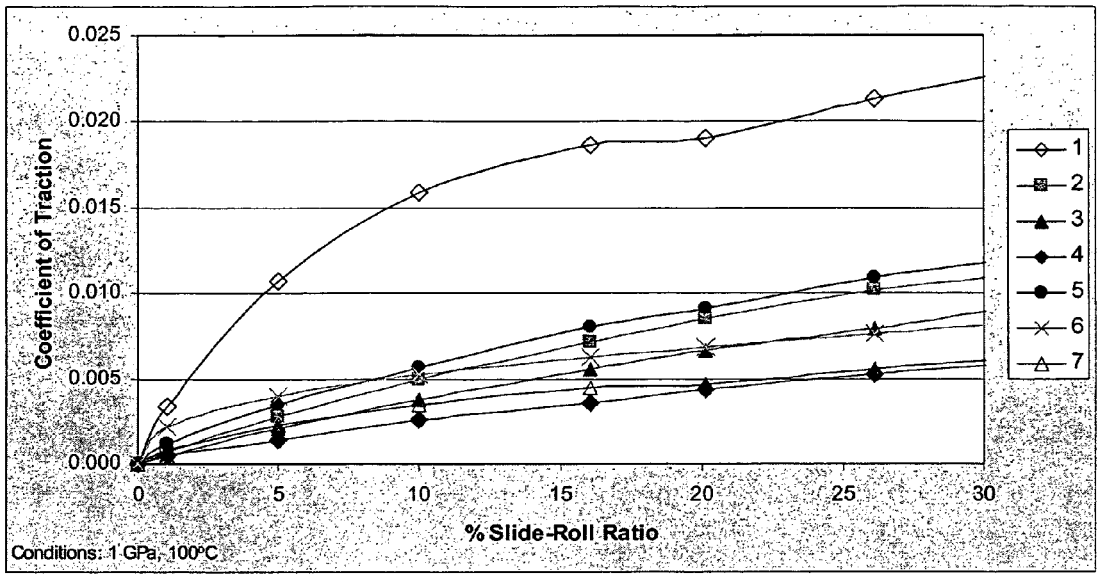

Thus, when the traction reducers according to the invention are blended with higher viscosity base stocks, a tremendous benefit is seen in the area of traction. For example, as shown in FIG. 4, the traction curves for several fluid combinations are shown. Table 1 provides a description of each combination. The data in the figure show the effect on the traction coefficient when various traction modifiers are added to PAO 150. The traction data used herein was, generated using a Mini Traction Machine (MTM) manufactured by PCS Instruments Ltd. in the UK. All remaining traction data were generated using this same apparatus. The lubricating composition of the invention may further be characterized by a having a traction coefficient less than the traction coefficient of the higher viscosity base stock for every percent slide-to-roll ratio greater than 5%, measured over the operating range of 0.1 to 3.5 GPa peak contact pressure, −40° C. to 200 C. lubricant temperature, with a lubricant entraining velocity of from 0.25 to 10.0 m/s. This data was obtained using the MTM set forth in this paragraph.

In FIG. 4, Fluid 1 is neat PAO 150 (SuperSyn™ 2150). Fluid 2 is a blend of this same PAO 150 with the traction reducer, 2 cSt PAO (SpectraSyn™ 2). Fluids 3 and 4 are blends of this same PAO 150 with monobasic esters isononyl heptanoate and C8-C10 ester of pentanoic acid, respectively, as the traction reducers. Fluids 5 and 6 are blends of PAO 150 with hydrocarbon solvents (Exxsol™ D110 and Norpar™ 14, respectively) as the traction reducers. Each of the traction reducers are present at a level of 55 wt. % in the PAO 150, the remainder being PAO 150. From the data in FIG. 4, it will be noted that the traction coefficients of Fluids 2 through 6 are lower at every slide-roll ratio tested. The C8-C10 ester of pentanoic acid is especially effective when combined with PAO 150.

TABLE 1

| Fluid Identification | Description |
|---|---|
| 1 | 100 wt % PAO 150 |
| 2 | 55 wt % PAO 2 - 45 wt. % PAO 150 |
| 3 | 55 wt % Heptanoic acid ester of isononyl alcohol - 45 wt. % PAO 150 |
| 4 | 55 wt % Pentanoic acid ester of C8–C10 alcohol - 45 wt. % PAO 150 |
| 5 | 55% wt % Exxsol ™ D110 (hydrocarbon solvent) - 45 wt. % PAO 150 |
| 6 | 55% wt % Norpar ™ 14 (hydrocarbon solvent) - 45 wt. % PAO 150 |
| 7 | Synalox 40 D300 (low traction PAG reference) |

Figure 5:
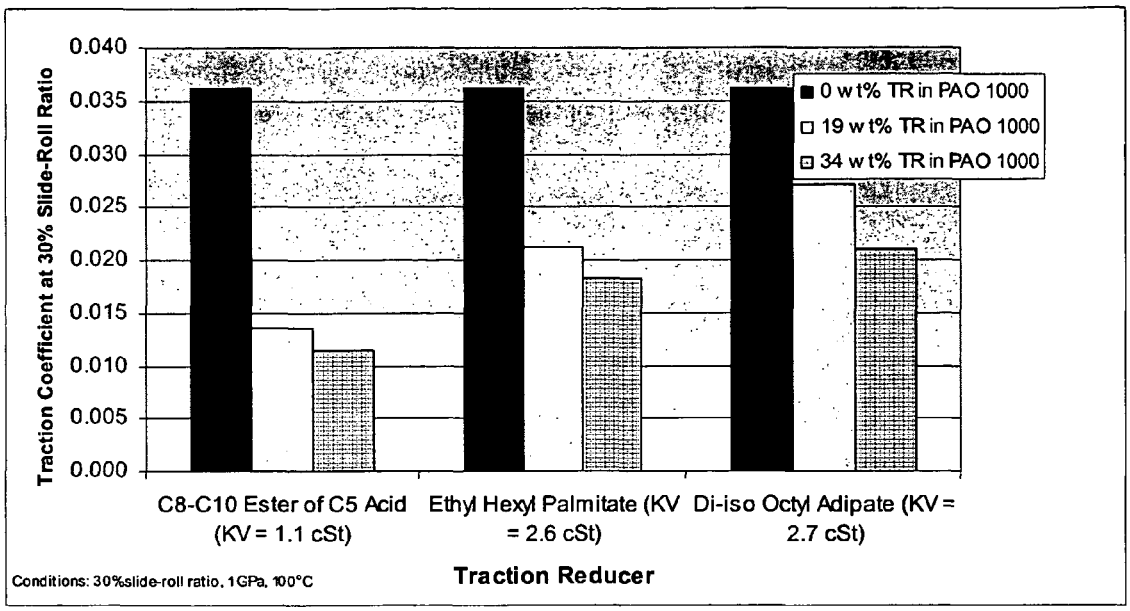

FIG. 5 shows another example of different traction reducers, each from the ester family and each with a different kinematic viscosity: ranging from 1.1 to 2.7 cSt. These traction reducers were combined with the high viscosity base oil PAO 1000, at several different concentrations. The coefficients of traction were measured at the slide-roll ratio of 30%. The reader will note that for each of these traction reducers, the traction of the blend containing the traction reducer, was significantly lessened over that of neat PAO 1000.

Figure 6:
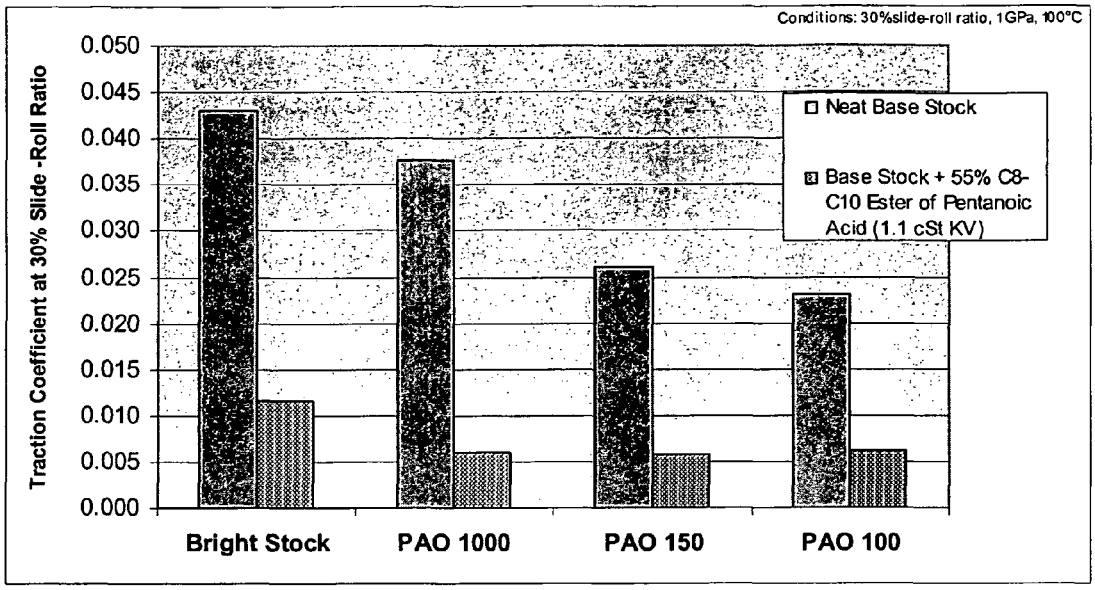

A formulator often has a choice of basestocks for thickening a formulation and the choice will depend on different factors such as targeted viscosity grade, degree of desired oxidative stability, economics, etc. Four such heavy base stocks are shown in Table 2 below: bright stock, PAO 100, PAO 150 (SuperSyn™ 2150), and PAO 1000 (SuperSyn™ 21000). When each of these are combined with a traction reducer, described by this invention, in this case, a pentanoic acid ester of a C8-C10 alcohol, the traction is reduced considerably for all four base stocks. Table 2 gives the traction coefficients for these four base stocks, both with and without the presence of a traction modifier, at a slide-roll ratio of 30%. FIG. 6 is a graphical representation of the resulting data, where the fluids containing the traction reducer are illustrated by the cross-hatched bars and stand alongside the corresponding fluids without a traction reducer (solid bars). For each base stock, the presence of the traction reducer, a C8-C10 ester of pentanoic acid, greatly reduced the coefficient of traction.

TABLE 2

| Base Stock | Base Stock | Base Stock + 55 wt % Traction Modifier |
|---|---|---|
| Bright Stock | 0.04310 | 0.01157 |
| PAO 1000 | 0.03760 | 0.006071 |
| PAO 150 | 0.02615 | 0.005736 |
| PAO 100 | 0.02303 | 0.006084 |

Note:
Coefficients of friction obtained using the following conditions: 30% slide-roll, 1 GPa, 100° C.

Figure 7:
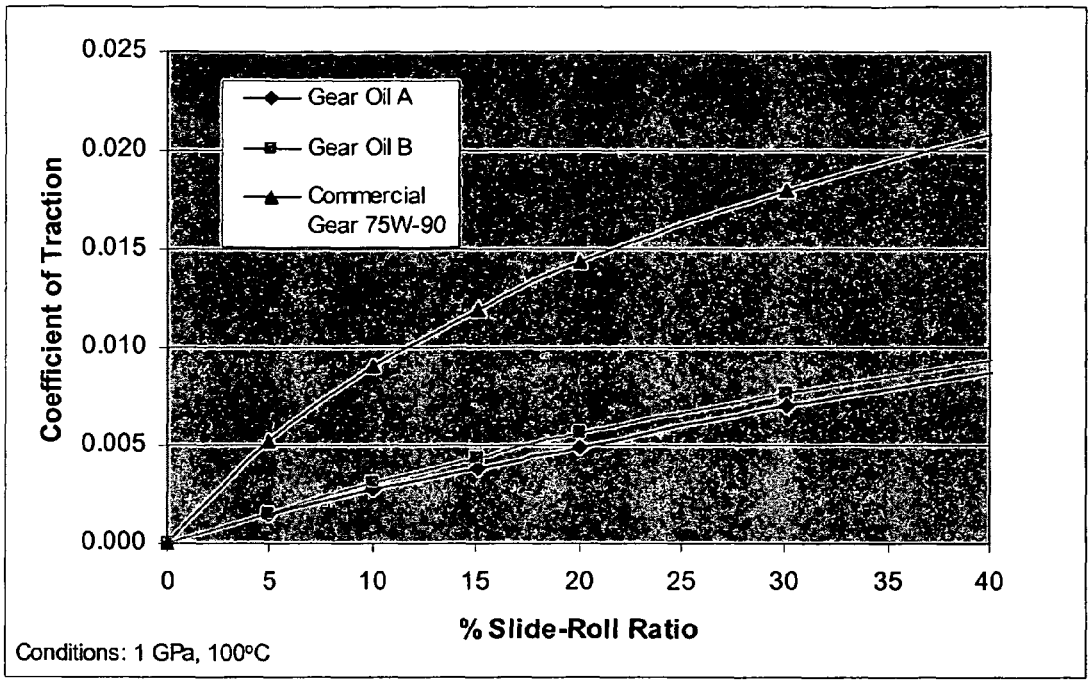

When a lubricant, e.g. an automotive gear oil, is formulated according to the invention, i.e. combining one or more traction reducers with a higher viscosity fluid, the resulting fluid is expected to produce reduced traction relative to fluids that are not formulated in this manner. Two fluids, Gear Oil A and B, were formulated in accordance with a preferred embodiment of this invention. Both contain two traction reducers, PAO 2 (SpectraSyn™ 2) and a monobasic ester with a kinematic viscosity of 1.3 cSt blended with PAO 150 (SuperSyn™ 2150). The formulation specifics are given in Table 3. These fluids were then evaluated for traction coefficient, along with a commercial gear oil 75W-90. The traction coefficient data are plotted in FIG. 7, which shows that traction coefficients at each slide-roll ratio are much lower than those of a commercial formulation for non-conforming concentrated contacts.

TABLE 3

| | PAO 2, wt % | PAO 150, wt % | i-Nonyl Heptanoate, wt % |
|---|---|---|---|
| Gear Oil A | 36.4 | 47.4 | 16.2 |
| Gear Oil B | 31.2 | 52.7 | 16.0 |

It is well known in the industry that lubricants with lower traction result in lower energy losses and less heat input to the oil. In gears for example, as teeth are meshing, the lubricant is subjected to high shear as the two surfaces move past one another. If low traction fluids are used, at any given instant in time there will be less traction between gear teeth, and hence, reduced energy losses. In general, low traction lubricants will reduce the load dependent losses in a system.

If there is less resulting heat input, then one would expect lower lubricant temperatures with reduced traction fluids. Evidence for this was collected using an Axle Efficiency-Durability Test, described below, using the compositions set forth in Table 4. In Table 4, compositions listed as Gear Oils C and D are formulations according to the present invention, in weight percent relative to the entire composition. The 75W-140 and 75W-90 are commercially available factory fill/service fill gear oils provided by Original Equipment Manufacturers (OEMs). These factory/service fill oils are used by major North American passenger car builders, and will be referred to as OEM A and B, respectively.

Conditioned axles were used in a T-bar type test configuration similar to ASTM D6121-01 (the L-37 gear durability test), with the exception that the power source is from a 250 hp electric motor and constant heat removal is provided by air fans directed at the axle carrier. The axle carrier is filled with test oil and then run through stages of torques and rpms. Each stage is held until the oil sump temperature has stabilized. The temperature of each stage is recorded along with torque out readings if the axle is properly instrumented. The test then moves to the next stage until all stages are completed.

TABLE 4

| | PAO 2 | PAO 150 | i-Nonyl Heptanoate | KV 100° C., cSt |
|---|---|---|---|---|
| Gear Oil C | 44.6 | 38.6 | 16.8 | 8.6 |
| Gear Oil D | 0 | 40.0 | 60.0 | 8.0 |
| 75W-90 OEM B Factory Fill | na | Na | Na | 17.5 |
| 75W-140 OEM A Factory Fill | na | Na | Na | 25.1 |

Sump temperatures were collected at each stage only after equilibrium was reached. In this particular test, Stages 1-3 were chosen to simulate fuel economy conditions, i.e. light loads and medium to high speeds. Stages 4, 6, 7, and 8 were higher stress conditions, yet still within equipment design. Stages 5, 9, 10, and 11 are considered to be durability stages, where high stress conditions prevail that are close to or beyond the hardware design envelope.

Figure 8:
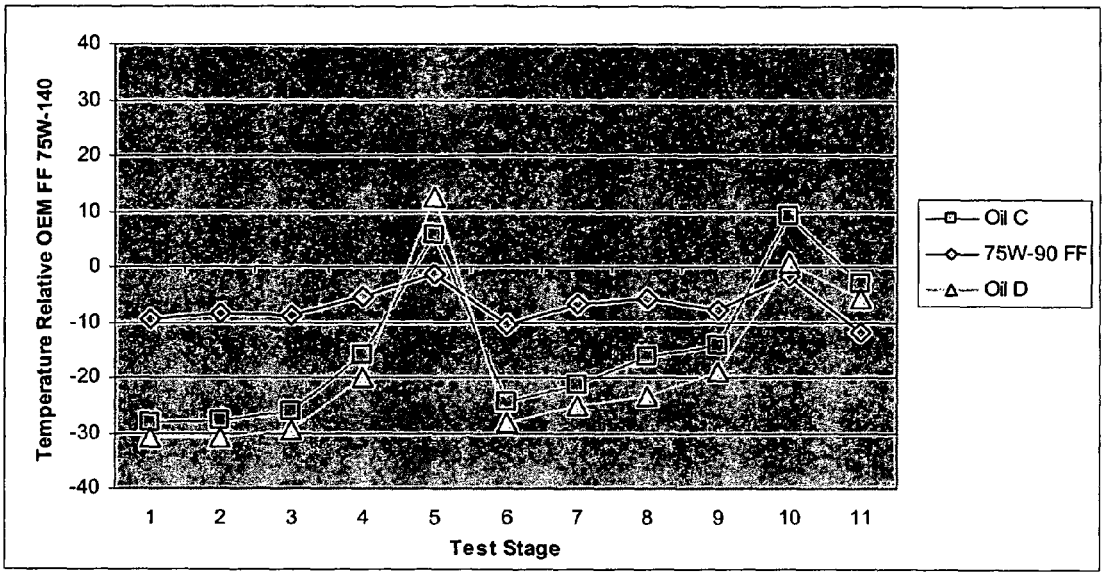

The data in Table 5 is plotted in the corresponding FIG. 8. The temperature differences (in ° F.) for three fluids at each stage relative to the factory fill 75W-140 are shown.

TABLE 5

| Test Stage | Oil C | Oil D | 75W-90 OEM B FF |
|---|---|---|---|
| 1 | −28 | −31 | −9 |
| 2 | −28 | −31 | −8 |
| 3 | −26 | −30 | −9 |
| 4 | −16 | −20 | −5 |
| 5 | 6 | 12 | −1 |
| 6 | −24 | −28 | −11 |
| 7 | −21 | −25 | −7 |
| 8 | −16 | −23 | −6 |
| 9 | −14 | −19 | −8 |
| 10 | 9 | 1 | −2 |
| 11 | −3 | −6 | −12 |

The Oil C and D, described by this invention, gave significantly lower temperatures than the 75W-140, except for stages 5 and 10, where they were slightly higher in temperature. The temperature reductions are also significantly greater than the factory fill 75W-90.

What is most interesting to note is that despite the low viscosities of these two low traction fluids, they are able to adequately maintain durability protection in the heavy load stages 5, 9, 10 and 11, which are meant to simulate uphill towing. The temperatures of Oils C and D are only about 5-10 degrees higher than the 75W-140 reference oil, which is a considerably more viscous oil. Therefore, one will get the fuel efficiency benefits attributed to a lower viscosity oil but will be able to maintain durability protection. This is typically not possible with a lighter viscosity oil.

Figure 9:
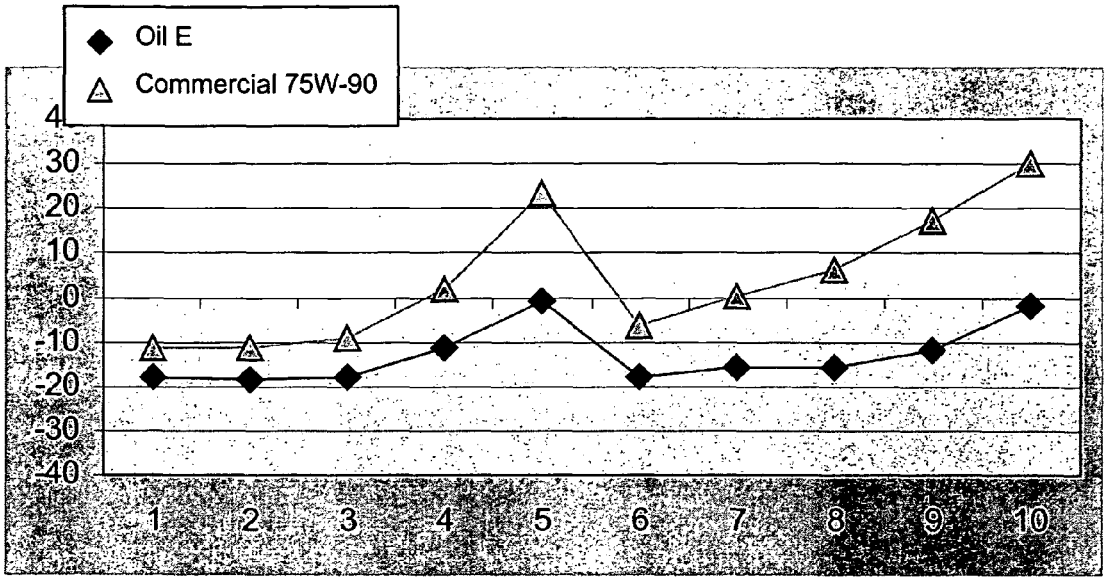

In a similar test, a conditioned axle from yet another axle manufacturer was used. Again, fuel economy and durability stages were combined, this time into a ten-stage test. Oil E, formulated according to the invention, was tested relative to the 75W-140 reference oil, and in every stage of the test was found to exhibit lower sump temperatures than the commercial 75W-140 and the commercial 75W-90, both of which are factory fill oils. The composition of Gear Oil E is shown in Table 6 below, and the results illustrated in FIG. 9. Compared to the 75W-140 synthetic factory fill gear oil and a commercial 75W-90 gear oil, Oil E provides substantial temperature reductions as demonstrated in the Axle Efficiency-Durability Test.

TABLE 6

| Name | Description | 100° C. KV |
|---|---|---|
| Gear Oil E | 17% isononyl heptanoate<br>49% PAO 150<br>34% PAO 2 | 14 |
| 75W-90 | Commercial Gear Oil | 14 |
| 75W-140 OEM FF | Commercial Factory Fill Gear Oil | 25 |

Note also that this predicted improvement in efficiency is accomplished without compromise to high load application protection. The comparative data demonstrates that film thickness was not compromised in the durability region. Oil E is significantly better at temperature control for the high load stages 5, 9 and 10 when contrasted to the commercial 75W-90 fluid, which has the same viscosity at 100° C. as Oil E. Oil E often beat the 75W-140 reference. This temperature reduction should increase the lifetime of the lubricant, i.e. longer oil drains can be anticipated, which will mean a cost savings to the equipment owner. The equipment lifetime and reliability should also increase if there are lower operating temperatures.

Fluids containing traction reducers, described by this invention, were tested at an independent testing facility in a five-day efficiency test. An axle fluid and a transmission fluid prepared using traction reducers according to the invention and PAO 150 (SuperSyn™ 2150) were tested along with a commercial mineral transmission oil, a synthetic transmission oil, a mineral axle oil and a synthetic axle oil. All the oils tested are listed in Tables 7 and 8. The composition of the transmission oil TO 3 and axle oil AO 2 is approximately the same as that shown by "Gear Oil A" in Table 3. The difference between the transmission oil TO 3 and axle oil AO 2 are the additive packages; the transmission oil contains a commercial transmission additive package and the axle oil contains a commercial gear additive package. It is interesting to note how much lower the Brookfield viscosities are of the fluids governed by this invention relative to the commercial fluids.

TABLE 7

| Transmission Oils | SAE | Base Stock | KV100 cSt | Brookfield (cP) −26° C. | Brookfield (cP) −40° C. |
|---|---|---|---|---|---|
| TO1 - Commercial | 80 | Mineral | 10.0 | 46,000 | — |
| TO2 - Commercial | 75W-80 | Synthetic | 10.5 | — | 27,600 |
| TO3 - Invention | 75W-85 | Synthetic | 11.7 | — | 8,850 |

TABLE 8

| Axle Oils | SAE | Base Stock | KV100 cSt | Brookfield (cP) −26° C. | Brookfield (cP) −40° C. |
|---|---|---|---|---|---|
| AO1 - Commercial | 75W-90 | Synthetic | 16.9 | — | 193,200 |
| AO2 - Invention | 70W-85 | Synthetic | 11.5 | — | 8,000 |
| AO3 - Commercial | 90 | Mineral | 17.2 | >400,000 | — |

Over a five week period, five different pairings of these fluids were examined, one per week. The pairings are shown in Table 9 below, along with the percent fuel efficiency improvement relative to the reference pairing AO 1 and TO 1.

TABLE 9

| Pair | Axle | Transmission | % FEI | |
|---|---|---|---|---|
| 1 | AO 1 | TO 1 | 0 | ← Reference pair |
| 2 | AO 2 | TO 1 | 1.92 | |
| 3 | AO 2 | TO 2 | 2.62 | |
| 4 | AO 2 | TO 3 | 2.74 | |
| 5 | AO 3 | TO 1 | 0.74 | |

The results in Table 9 reveal that the highest percentage of fuel efficiency improvement could be found with the two fluids of this invention, pair # 4. In fact, there was substantial fuel economy improvement when the axle oil described by this invention was paired with any of the three transmission oils, including the commercial mineral and the commercial synthetic.

For industrial gears, one common type of gearing is worm gears. Worm gears form an extended elliptical contact against the wheel and operate under high sliding EHL conditions. Therefore, there is a significant benefit to low traction fluids in terms of energy savings.

Quantifying the amount of efficiency that can be expected is difficult because it is dependent on many factors. In worm gears for example, the amount of efficiency seen will depend on many factors including the shaft bearings, seals, churning losses, gear meshing, gear reduction ratios, etc. However, it is estimated that the gains may be substantial due to the high sliding and generally high energy losses. Steel gears are generally more efficient than bronze worm gears, and therefore, the absolute efficiency gains will be lessened.

Nevertheless, one of ordinary skill in the art can quantify fuel efficiency of a gear system by numerous methods and more particularly can determine an improvement in such system for embodiments of compositions according to the present invention compared with lubricant composition that do not show an improvement. Likewise, the energy efficiency of a machine operating said gear system can be readily determined and comparisons made.

Rolling element bearings have many configurations and depending on the type of configuration, there may or may not be a benefit to having a lower traction fluid. This may also be determined by one of ordinary skill in the art in possession of the present disclosure. Where there is sliding between the ball and the raceway, the oil is being sheared such that the reduced traction properties of the lubricants described in this invention will reduce the energy losses.

The present invention is particularly beneficial in any system that includes machine elements that contain gears of any kind and rolling element bearings. Examples of such systems include electricity generating systems, industrial manufacturing equipment such as paper, steel and cement mills, hydraulic systems, automotive drive trains, aircraft propulsion systems, etc. It will be recognized by one of ordinary skill in the art in possession of the present invention that the various embodiments set forth herein, including preferred and more preferred embodiments, may be combined in a manner consistent with achieving the objectives of the present invention. Thus by way of example, a preferred embodiment of the present invention includes a lubricating composition comprising:(a) at least one basestock, said basestock characterized by having a viscosity greater than 3 cSt at 100° C. (ASTM D-445); (b) at least one traction reducer, said traction reducer characterized by being miscible with said basestock and having a viscosity of less than or equal to 3 cSt at 100° C. (ASTM D-445) and having a traction coefficient less than the traction coefficient of the base stock described in (a); wherein (a) is present in the amount of from 1 to 99 wt. %, and (b) is present in the amount of 99 wt. % to 1 wt. %, based on the weight of said lubricating composition; and wherein said lubricating composition is characterized, after blending, by a traction coefficient less than the traction coefficient of (a) for every percent slide-to-roll ratio greater than or equal to 5% (or greater than 5% or from greater than 5% to 30% or from 5% to 20%, or greater than or equal to 20%, or greater than 20%), measured over the operating range of 0.1 to 3.5 GPa peak contact pressure, −40° C. to 200° C. lubricant temperature, with a lubricant entraining velocity of from 0.25 to 10.0 m/s; and especially wherein said composition is further characterized by one of the following: (i) wherein (a) is selected from esters, PAGs, and alkylated naphthalenes; (ii) wherein (b) is selected from monobasic acid esters and (a) is not a PAO; (iii) wherein (b) is a hydrocarbon fluid selected from normal paraffins, isoparaffins, dearomatized hydrocarbon fluids, and aliphatic hydrocarbon fluids; and/or or one or more of the following preferred embodiments: wherein said at least one basestock has a viscosity of at least 100 cSt, optionally greater than 140 cSt, optionally greater than or equal to 150 cSt, said viscosity measured according to ASTM D-445 at 100° C.; wherein (a) and (b) combined comprise greater than 50 wt. % of said lubricating composition; wherein said traction reducer is characterized by a viscosity of less than 3 cSt, optionally less than or equal to 2 cSt, optionally less than 2 cSt, optionally less than 1.3 or 1.2, or 1 cSt, said viscosity measured according to ASTM D-445 at 100° C.; wherein said traction reducer is further characterized by having an average carbon number of C5-C30, optionally C10-C25, optionally C12-C20; wherein said traction reducer is characterized by having a viscosity less than 2 cSt according to ASTM D-445 at 100° C. and an average carbon number of C5-C30; wherein said base stock is characterized by having a viscosity of greater than or equal to 20 cSt according to ASTM D-445 at 100° C.; wherein said base stock is characterized by having a viscosity of at least 100 cSt according to ASTM D-445 at 100° C.; wherein said base stock is characterized by having a viscosity of greater than 140 cSt according to ASTM D-445 at 100° C.; wherein (a) comprises at least one material selected from API Groups I-V and hydrocarbon fluids; wherein (a) comprises at least one basestock selected from API Group V; wherein (a) comprises at least one basestock selected from esters, PAGs, and alkylated naphthalenes; wherein (a) comprises at least one polyalphaolefin; wherein (a) comprises at least one basestock selected from API Group V, synthetic hydrocarbons, and mineral oils; wherein (b) is selected from PAO 2 and a monobasic acid ester; wherein (b) comprises at least one monobasic acid ester, particularly where the esterifying alcohol is selected from at least one C8-C13 alcohol or more preferably at least one C8-C10 alcohol and/or where the esterifying acid is a C5-C7 acid; wherein (a) comprises PAO 150 and (b) comprises PAO 2; wherein (a) comprises PAO 150 and (b) comprises isoheptanoate and PAO 2; wherein the −40° C. Brookfield viscosity is <150,000 cP and the −55° C. Brookfield viscosity is <1,000,000 cP (ASTM D-2983); wherein (a) is present in the amount of greater than 5 wt. %, optionally greater than 20 wt. %, optionally greater than 25 wt. %, optionally greater or equal to 45 wt. %, optionally greater than 55 wt. %, based on the weight of the lubricant composition; wherein (b) is present in the amount of greater than 5 wt. %, optionally greater than 20 wt. %, optionally greater than 25 wt. %, optionally greater or equal to 45 wt. %, optionally greater than 55 wt. %, based on the weight of the lubricant composition; wherein said lubricant composition is characterized by having a traction coefficient at least 5% lower, preferably 10% lower, more preferably 20% lower, still more preferably 30% lower, yet still more preferably 40% lower, yet again more preferably 50% lower than the traction coefficient of (a) for every percent slide-roll ratio from 5 to 30; wherein the composition(s) further comprising additives selected from thickeners, VI improvers, pour point depressants, extreme pressure agents, anti-wear additives, friction modifiers, demulsifiers, haze inhibitors, chromophores, anti-oxidants, dispersants, detergents, defoamants, anti-rust additives, metal passivators, limited slip additives, and mixtures thereof; or where the composition is characterized by the absence of one or more of said additives, especially where it is characterized by the absence of VI improvers having a number average or weight average molecular weight of about 100,000 or greater; wherein said lubricating composition is further characterized as formulated so as to be suitable for use as an automatic transmission fluid, a manual transmission fluid, an axle lubricant, a transaxle lubricant, an industrial gear lubricant, a circulating lubricant, an open gear lubricant, an enclosed gear lubricant, an hydraulic/tractor fluid, or a grease; wherein said lubricating composition is further characterized as formulated so as to be suitable for use as an automotive gear lubricating composition; wherein said lubricating composition is further characterized by a traction coefficient of less than 0.15, preferably from 0.15 and 0.0001, more preferably 0.015 to 0.001, measured over the operating range for determination of traction performance of 0.1 GPa to 3.5 GPa peak contact pressure, at −40° C. to 200° C. lubricant temperature and at % slide-to-roll ratios of greater than 20%, with a lubricant entraining velocity 0.25 m/s to 10 m/s; and also to compositions that do not contain PAO 2 or do not contain PAO 150, or do not contain PAO 2 and do not contain PAO 150; to compositions that contain GTL fluids and also to compositions that do not contain GTL fluids; and also to a method of reducing the traction coefficient of a lubricant composition comprising a basestock having a viscosity greater than 3 cSt at 100° C. (ASTM D-445), said method comprising adding a traction reducer to said lubricant composition (or otherwise blending the traction reducer and the ingredients of said lubricant composition) in an amount sufficient to reduce the traction coefficient of said lubricant composition for every percent slide-roll ratio greater than or equal to 5, measured over the operating range of 0.1 to 3.5 GPa peak contact pressure, at −40° C. to 200° C. lubricant temperature, with a lubricant entraining velocity of from 0.25 to 10.0 m/s, said traction reducer further characterized by being miscible with said basestock and having a viscosity of less than or equal to 3 cSt at 100° C. (ASTM D-445); and to a preferred method wherein said lubricant composition is further characterized by any one of the compositions set forth in this paragraph or any embodiments of the invention set forth herein.

Trade names used herein are indicated by a ™ symbol or ® symbol, indicating that the names may be protected by certain trademark rights, e.g., they may be registered trademarks in various jurisdictions. All patents and patent applications, test procedures (such as ASTM methods, UL methods, API classifications, and the like), and other documents cited herein are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

What is claimed is:

1. A method of reducing the traction coefficient of a lubricant composition comprising a basestock selected from API Group I fluids, API Group II fluids, API Group III fluids, esters, polyalkylene glycol, alkylated naphthalene, or poly alpha-olefins oligomerized from linear C5 to C14 alpha-olefins, the basestock having a viscosity of at least 100 cSt at 100° C. (ASTM D-445), said method comprising blending a traction reducer in an amount in the range of 30 to 70 wt % based on the combined weight of said basestock wherein the traction coefficient of said lubricant composition is less than the traction coefficient of said basestock for every percent slide-roll ratio greater than or equal to 5, measured over the operating range of 0.1 to 3.5 GPa peak contact pressure, at −40° C. to 200° C. lubricant temperature, with a lubricant entraining velocity of from 0.25 to 10.0 m/s, said traction reducer further characterized by being miscible with said basestock, selected from API Group V or a non API category hydrocarbon fluid and having a viscosity of less than or equal to 3 cSt at 100° C. (ASTM D-445).

2. The method of claim 1, wherein said traction reducer is a monobasic acid ester.

3. The method of claim 1, wherein said traction reducer is further characterized by a viscosity of less than or equal to 1.3 cSt at 100° C. (ASTM D-445).

4. The method of claim 1, wherein said traction reducer is a hydrocarbon fluid selected from normal paraffins, isoparaffins, dearomatized hydrocarbon fluids, and aliphatic hydrocarbon fluids.

5. The method of claim 1, wherein said traction reducer is added in an amount of at least 50 to 70 wt %, based on the combined weight of said basestock and said traction reducer.

6. The method of claim 1, wherein the lubricant composition after said blending is characterized by having a traction coefficient at least 5% lower than the traction coefficient of said lubricant composition for every percent slide-roll ratio from 5 to 30.

7. The method of claim 1, further comprising, after said blending, measuring an improvement in the energy efficiency of a gear system and/or the fuel efficiency of a machine or apparatus comprising said gear system, said gear system lubricated by said lubricant composition including said traction reducer.

8. The method of claim 1, wherein said basestock is selected from PAO 100, PAO 150, PAO 1000, and mixtures thereof.

9. The method of claim 1, wherein said basestock includes PAO 150.

10. The method of claim 1, wherein said basestock consists essentially of PAO 150.

11. A lubricating composition comprising:

(a) at least one basestock, said basestock characterized by having a viscosity of at least 100 cSt at 100° C. (ASTM D-445), and selected from API Group I fluids, API Group II fluids, API Group III fluids, esters, polyalkylene glycol, alkylated naphthalene, or poly alpha-olefins oligomerized from linear C5 to C14 alpha-olefins;

(b) at least one traction reducer, said traction reducer characterized by being miscible with said basestock and having a viscosity of less than or equal to 3 cSt at 100° C. (ASTM D-445) and having a traction coefficient less than the traction coefficient of the base stock described in (a);

wherein the at least one traction reducer (b) is present in the amount of 30 to 70 wt. %, based on the weight of said lubricating composition; and wherein said lubricating composition is characterized by a traction coefficient less than the traction coefficient of the at least one basestock for every percent slide-to-roll ratio greater than 5%, measured over the operating range of 0.1 to 3.5 GPa peak contact pressure, −40° C. to 200° C. lubricant temperature, with a lubricant entraining velocity of from 0.25 to 10.0 m/s;

said composition further characterized by one of the following:

(i) wherein (a) is selected from esters, PAGs, and alkylated naphthalenes; or (ii) wherein (b) is selected from monobasic acid esters and (a) is not a PAO.

12. The lubricating composition according to claim 11, wherein (a) and (b) combined comprise greater than 50 wt % of said lubricating composition.

13. The lubricating composition according to claim 11, wherein said traction reducer is characterized by a viscosity of less than 1.3 cSt at 100° C. (ASTM D-445).

14. The lubricating composition according to claim 11, wherein said traction reducer is further characterized by having an average carbon number of C5-C30.

15. The lubricating composition according to claim 11, wherein said traction reducer is characterized by having a viscosity less than 2 cSt at 100° C. (ASTM D-445) and an average carbon number of C5-C30.

16. The lubricating composition according to claim 11, wherein (a) is characterized by having a viscosity of greater than 140 cSt at 100° C. (ASTM D-445).

17. The lubricating composition according to claim 11, wherein (a) comprises at least one polyalphaolefin.

18. The lubricating composition according to claim 11, wherein (b) is selected from at least one monobasic acid ester and (b) is present in the amount of at least 50 wt % based on the weight of (a) and (b).

19. The lubricating composition according to claim 11, wherein (b) comprises at least one monobasic acid ester.

20. The lubricating composition according to claim 11, wherein the −40° C. Brookfield viscosity is <150,000 cP and the −55° C. Brookfield viscosity is <1,000,000 cP (ASTM D-2983).

21. The lubricating composition according to claim 11, characterized by the absence of any VI improver having a molecular weight of about 100,000 or greater.

22. The lubricating composition according to claim 11, wherein said lubricating composition is further characterized as formulated so as to be suitable for use as an automotive gear lubricating composition.

23. The lubricating composition according to claim 11, wherein said lubricating composition is further characterized by a traction coefficient of less than 0.15, measured over the operating range for determination of traction performance of 0.1 GPa to 3.5 GPa peak contact pressure, at −40° C. to 200° C. lubricant temperature and at % slide-to-roll ratios of greater than 20%, with a lubricant entraining velocity 0.25 m/s to 10 m/s.

24. The lubricating composition of claim 11, wherein (b) comprises a monobasic acid ester made by esterifying at least one alcohol selected from C8 to C10 alcohols and at least one acid selected from C5 to C7 carboxylic acids.

25. The lubricating composition of claim 11, wherein (b) comprises the pentanoic acid ester of C8 to C10 alcohols.

26. In an apparatus comprising roller or spherical bearings, hypoid axles or gears or worm gears in contact with a lubricating fluid, the improvement comprising a lubricating fluid characterized by:

(a) at least one basestock selected from API Group I fluids, API Group II fluids, API Group III fluids, esters, polyalkylene glycol, alkylated naphthalene, or poly alpha-olefins oligomerized from linear C5 to C14 alpha-olefins, said basestock characterized by having a viscosity of at least 100 cSt at 100° C. (ASTM D-445);

(b) at least one traction reducer, said traction reducer characterized by being miscible with said basestock, selected from API Group V fluids or a non API category hydrocarbon fluid, and having a viscosity of less than or equal to 3 cSt at 100° C. (ASTM D-445) and having a traction coefficient less than the traction coefficient of the base stock described in (a);

wherein the at least one traction reducer (b) is present in the amount of 30 to 70 wt. %, based on the weight of said lubricating composition; and wherein said lubricating composition is further characterized by a traction coefficient less than the traction coefficient of said at least one basestock (a) for every percent slide-to-roll ratio greater than 5%, measured over the operating range of 0.1 to 3.5 GPa peak contact pressure, −40° C. to 200° C. lubricant temperature, with a lubricant entraining velocity of from 0.25 to 10.0 m/s.

27. The apparatus of claim 26, wherein said lubricating fluid is characterized by the composition according to claim 11.

* * * * *